US010379476B1

(12) United States Patent
Nishiwaki

(10) Patent No.: US 10,379,476 B1
(45) Date of Patent: Aug. 13, 2019

(54) IMAGE FORMING APPARATUS AND CONTROL METHOD FOR EXECUTING A CLEANING PROCESS ON A TRANSFER ROLLER

(71) Applicants: KABUSHIKI KAISHA TOSHIBA, Tokyo (JP); TOSHIBA TEC KABUSHIKI KAISHA, Tokyo (JP)

(72) Inventor: Kazuhiro Nishiwaki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,531

(22) Filed: Mar. 22, 2018

(51) Int. Cl.
*G03G 15/16* (2006.01)
*G03G 15/00* (2006.01)
*G03G 21/16* (2006.01)

(52) U.S. Cl.
CPC ..... *G03G 15/5033* (2013.01); *G03G 15/16* (2013.01); *G03G 21/1633* (2013.01); *G03G 2215/1652* (2013.01); *G03G 2221/0005* (2013.01)

(58) Field of Classification Search
CPC . G03G 15/161; G03G 15/168; G03G 21/1633
USPC ..... 399/9, 101, 110
See application file for complete search history.

(56) References Cited

U.S. PATENT DOCUMENTS 5,621,509 A * 4/1997 Karashima et al. ..... G03G 15/168 399/66
8,577,248 B2 11/2013 Kawasaki et al.
9,645,528 B2 * 5/2017 Minato ..... G03G 15/161

* cited by examiner

*Primary Examiner* — William J Royer
(74) *Attorney, Agent, or Firm* — Kim & Stewart LLP

(57) ABSTRACT

An image forming apparatus includes a photoconductive drum, a transfer roller configured to transfer a visible image formed on the photoconductive drum to a sheet, and a processor. The processor is configured to acquire an interruption time, which is measured after a process including charging of the photoconductive drum is interrupted, and is equal to an amount of time elapsed while the photoconductive drum is in a charged state, determine a cleaning time depending on the interruption time, and execute a cleaning process on the transfer roller for the duration of the cleaning time.

20 Claims, 8 Drawing Sheets

| INTERRUPTION TIME | EXECUTION TIME |
|---|---|
| 0~5 MINUTES | 40 SECONDS |
| 5~10 MINUTES | 20 SECONDS |
| 10~15 MINUTES | 10 SECONDS |
| GREATER THAN OR EQUAL TO 15 MINUTES | 5 SECONDS |

| INTERRUPTION TIME | EXECUTION TIME | |
|---|---|---|
| | COVER IS CLOSED | COVER IS OPENED |
| 0~5 MINUTES | 40 SECONDS | 20 SECONDS |
| 5~10 MINUTES | 20 SECONDS | 10 SECONDS |
| 10~15 MINUTES | 10 SECONDS | 5 SECONDS |
| GREATER THAN OR EQUAL TO 15 MINUTES | 5 SECONDS | 2 SECONDS |

| | | CLEANING BIAS ROTATION NUMBER | | | | | |
|---|---|---|---|---|---|---|---|
| | | 1 | 2 | 5 | 7 | 8 | 10 |
| BACK DIRT LEVEL | 5 | 5 | 5 | 3 | 1 | 0 | 0 |
| | 4 | 4 | 4 | 2 | 0 | 0 | 0 |
| | 3 | 4 | 2 | 0 | 0 | 0 | 0 |
| | 2 | 4 | 1 | 0 | 0 | 0 | 0 |
| | 1 | 1 | 0 | 0 | 0 | 0 | 0 |
| | 0.5 | 0 | 0 | 0 | 0 | 0 | 0 |

IMAGE FORMING APPARATUS AND CONTROL METHOD FOR EXECUTING A CLEANING PROCESS ON A TRANSFER ROLLER

FIELD

Embodiments described herein relate generally to an image forming apparatus and a control method.

BACKGROUND

An image forming process of an image forming apparatus is interrupted when a power failure occurs or when amain body cover is opened. Since deviation in the timing of each function within the image forming apparatus is generated when the image forming apparatus returns from the interruption, defects are generated. For example, unnecessary toner may adhere to a charged photoconductor, and in turn stain a transfer roller. The interruption corresponding to the power failure or the opening of the main body cover is generated at an unexpected timing, and so it is difficult to take measures that would prevent the occurrence of defects.

DETAILED DESCRIPTION

In accordance with an embodiment, an image forming apparatus comprises a photoconductive drum, a transfer roller configured to transfer a visible image formed on the photoconductive drum to a sheet, and a processor. The processor is configured to acquire an interruption time, which is measured after a process including charging of the photoconductive drum is interrupted, and is equal to an amount of time elapsed while the photoconductive drum is in a charged state, determine a cleaning time depending on the interruption time, and execute a cleaning process on the transfer roller for the duration of the cleaning time.

Figure 1:
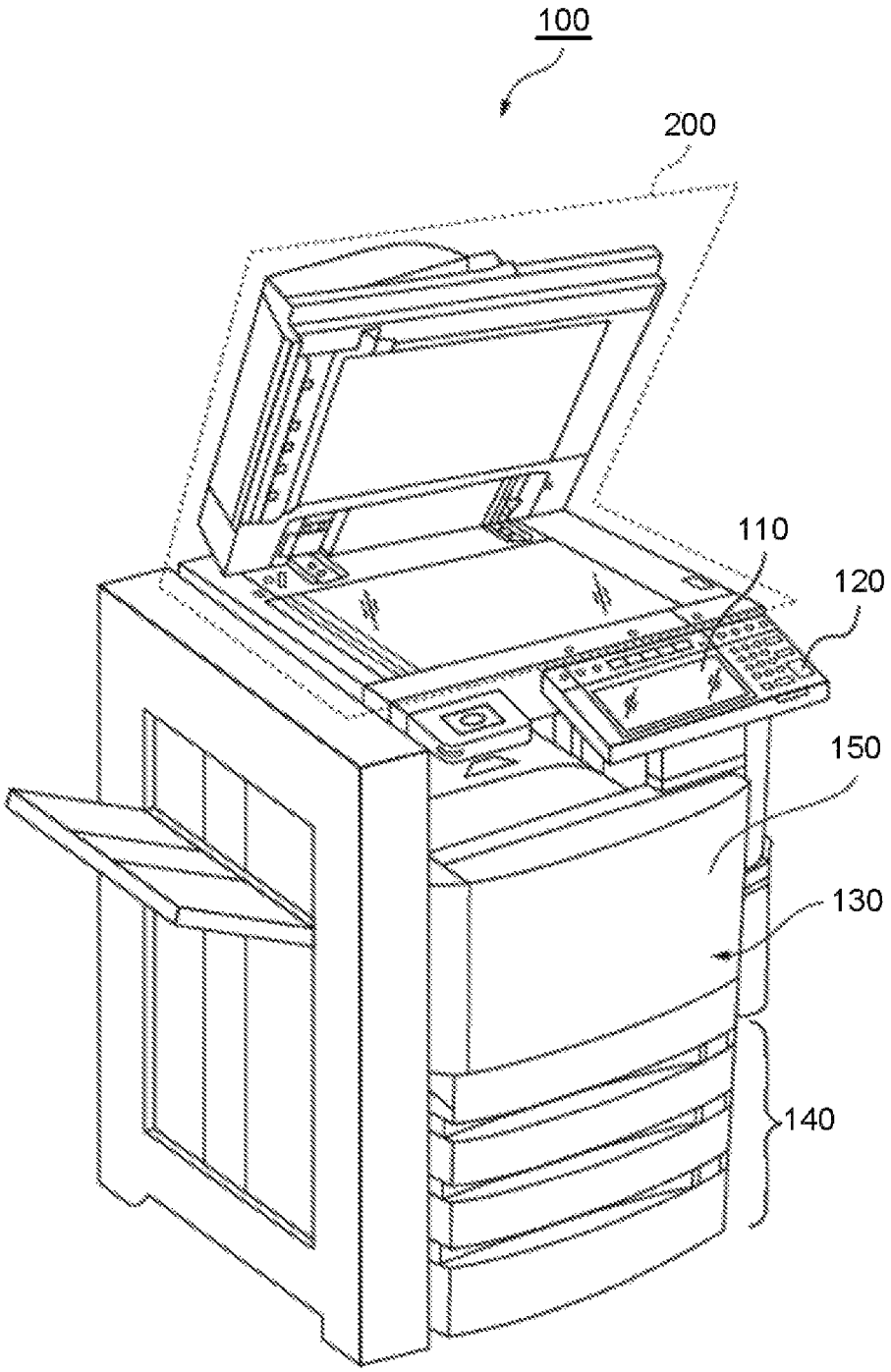
FIG. 1 is an external view of an image forming apparatus according to an embodiment.

FIG. 1 is an external view of an image forming apparatus 100 according to an embodiment. The image forming apparatus 100 is, for example, an MFP (Multifunction Peripheral). The image forming apparatus 100 includes a display 110, a control panel 120, a printer section 130, a sheet housing section 140, a main body cover 150 and an image reading section 200.

The image forming apparatus 100 forms an image on a sheet with a developing agent such as toner. The sheet is, for example, a paper or a label paper, or any other medium as long as the image forming apparatus 100 can form an image on the surface of the medium.

The display 110 is an image display device such as a liquid crystal display, an organic EL (Electro Luminescence) display and the like. The display 110 displays various kinds of information relating to the image forming apparatus 100.

The control panel 120 includes a plurality of buttons. The control panel 120 receives an operation of a user. The control panel 120 outputs a signal corresponding to an operation carried out by a user to a control section of the image forming apparatus 100. Furthermore, the display 110 and the control panel 120 can be separate or both may be integrated into a single touch panel.

The printer section 130 forms an image on a sheet on the basis of image information generated by the image reading section 200 or image information received via a communication path. The printer section 130 forms the image with, for example, the following process. An image forming section of the printer section 130 forms an electrostatic latent image on a photoconductive drum on the basis of the image information. The image forming section of the printer section 130 enables a developing agent to adhere to the electrostatic latent image to form a visible image. Toner is an example of the developing agent. A transfer section of the printer section 130 transfers the visible image on the sheet. A fixing section of the printer section 130 heats and pressures the sheet to enable the visible image to be fixed on the sheet. Furthermore, the sheet on which the image is formed may be a sheet housed in the sheet housing section 140 or a manually fed sheet.

The sheet housing section 140 houses the sheet used for the image formation by the printer section 130.

The main body cover 150 covers mechanisms of the printer section 130 of the image forming apparatus 100. The main body cover 150 is configured to be openable/closable. For example, in a case in which an abnormality is generated in the printer section 130 (for example, jam is generated), the main body cover 150 is opened. It is possible that a user deals with the abnormality of the printer section 130 by opening the main body cover 150.

The image reading section 200 reads the image information of a read target object as intensity of light. The image reading section 200 records the read image information. The recorded image information may be sent to another information processing apparatus via a network. The recorded image information may be used for the image formation on the sheet through the printer section 130.

Figure 2:
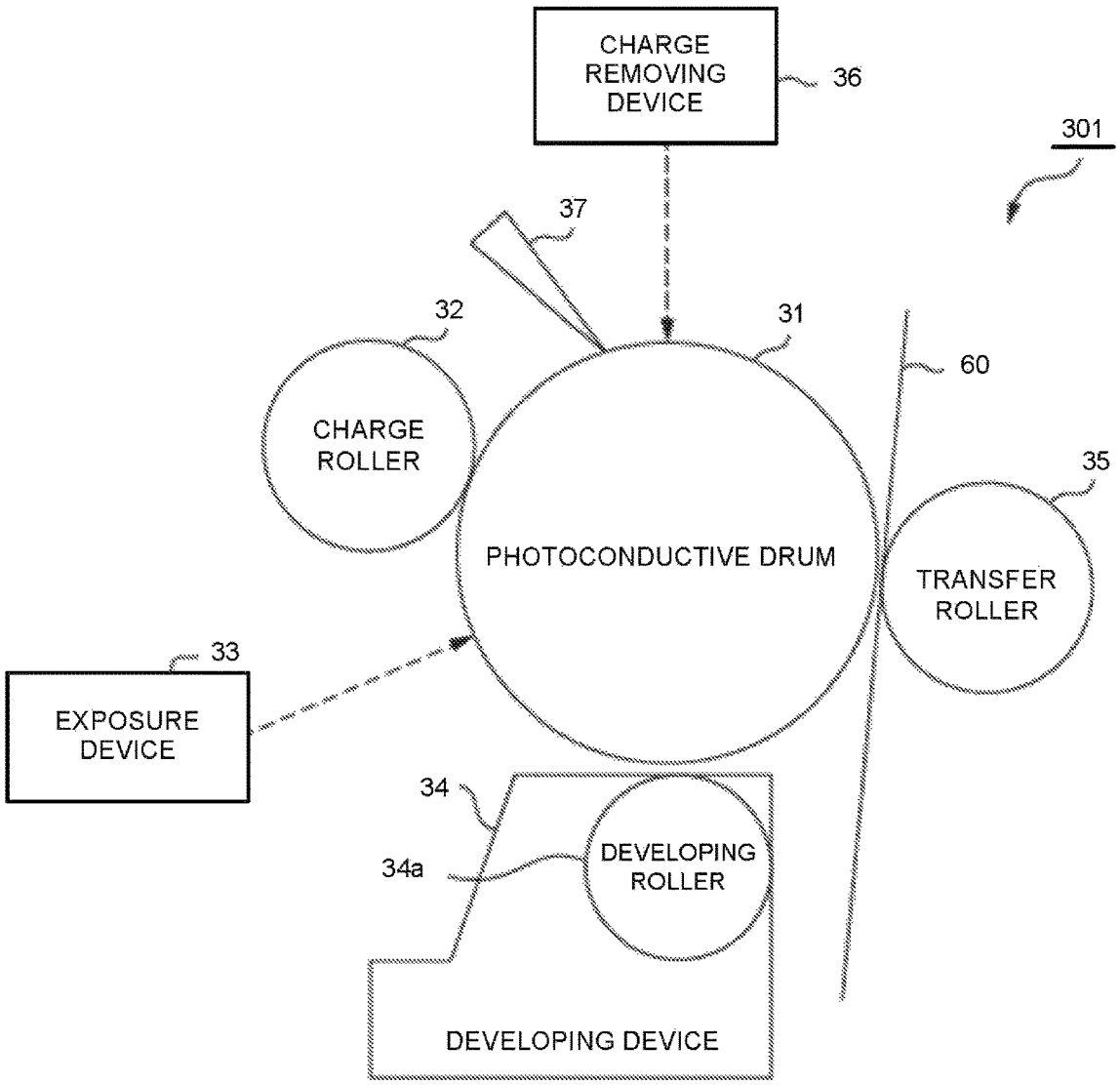
FIG. 2 is a schematic diagram illustrating physical components of an image forming section included in a printer section according to the embodiment.

FIG. 2 is a schematic diagram illustrating physical components of an image forming section 301 included in the printer section 130 according to the embodiment. The image forming section 301 includes a photoconductive drum 31, a charge roller 32, an exposure device 33, a developing device 34, a transfer roller 35, a charge removing device 36 and a cleaning blade 37. The developing device 34 includes a developing roller 34*a*. The photoconductive drum 31, the charge roller 32, the developing roller 34*a* and the transfer roller 35 have a width corresponding to a sheet 60. The sheet width direction corresponds to a depth direction in FIG. 2.

Hereinafter, the flow of a process when the image forming section 301 normally carries out image formation is described. The photoconductive drum 31 is rotated in the counterclockwise direction in FIG. 2. The charge roller 32 charges the surface of the photoconductive drum 31 with a predetermined potential.

The exposure device 33 exposes the surface of the photoconductive drum 31 depending on an image formed on the sheet 60. The potential of a part of the surface of the photoconductive drum 31 exposed by the exposure device 33 is changed. Thus, the potential of the exposed part of the surface of the photoconductive drum 31 is different from the potential of an unexposed part thereof. An electrostatic latent image is formed on the photoconductive drum 31 by changing the potential in this way.

The developing device 34 holds toner therein. The developing roller 34*a* is rotated while holding the toner positioned inside the developing device 34 on the surface. The toner held on the surface of the developing roller 34*a* adheres to a part of the electrostatic latent image on the surface of the photoconductive drum 31. In this way, the toner adheres to the electrostatic latent image on the photoconductive drum 31, and a visible image is formed.

A bias having a polarity opposite to that of the toner is applied to the transfer roller 35 at the time of an image forming process. The toner on the surface of the photoconductive drum 31 is attracted to the transfer roller 35 by an electrostatic force. As a result, the visible image formed on the surface of the photoconductive drum 31 is transferred to the surface of the sheet 60.

The charge removing device 36 irradiates the surface of the photoconductive drum 31 with light. A charge applied to the surface of the photoconductive drum 31 by the charge roller 32 is removed through the irradiation of the light by the charge removing device 36. Thus, a potential difference becomes substantially zero in an area irradiated by the charge removing device 36 until the area reaches the charge roller 32.

The cleaning blade 37 removes the toner adhering to the surface of the photoconductive drum 31 from the surface of the photoconductive drum 31.

Figures 3, 4:
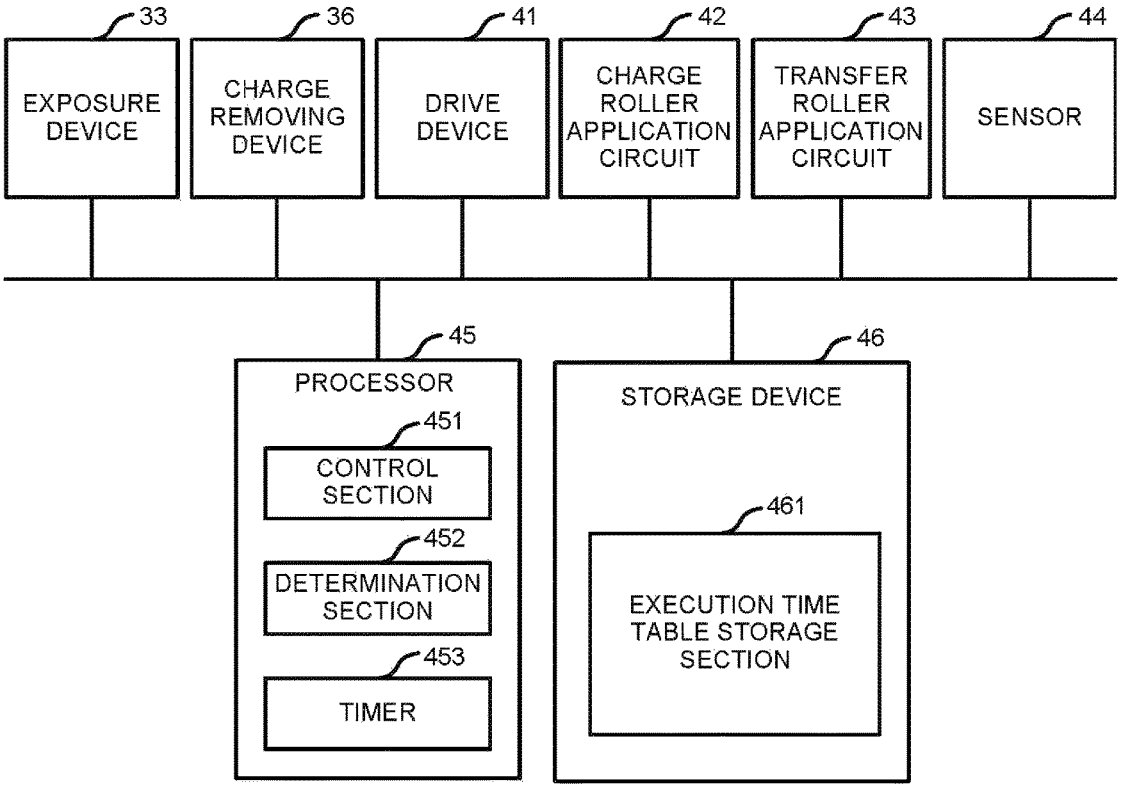
FIG. 3 is a block diagram illustrating hardware components of the image forming apparatus according to the embodiment.
FIG. 4 is a diagram illustrating a specific example of an execution time table.

FIG. 3 is a block diagram illustrating hardware components of the image forming apparatus 100 according to the embodiment. The image forming apparatus 100 includes the exposure device 33, the charge removing device 36, a drive device 41, a charge roller application circuit 42, a transfer roller application circuit 43, a sensor 44, a processor 45 and a storage device 46.

The exposure device 33 includes, for example, a light emitting device such as a LED (Light Emitting Diode). The exposure device 33 exposes an image that is the object of image formation onto the surface of the photoconductive drum 31 depending on the control of a control section 451 of the processor 45.

The charge removing device 36 includes, for example, a light emitting device such as the LED. The charge removing device 36 irradiates the surface of the photoconductive drum 31 with light for charge removal depending on the control of the control section 451 of the processor 45.

The drive device 41 is, for example, a motor. The drive device 41 drives other devices depending on the control of the control section 451 of the processor 45. The drive device 41 rotates, for example, the photoconductive drum 31, the charge roller 32, the developing roller 34*a* and the transfer roller 35.

The charge roller application circuit 42 is used to apply a predetermined bias to the charge roller 32. The charge roller application circuit 42 applies a charge to the charge roller 32 depending on the control of the control section 451 of the processor 45.

The transfer roller application circuit 43 is used to apply a charge to the transfer roller 35. There are at least two bias values in the charge applied to the transfer roller 35 by the transfer roller application circuit 43. The first bias value is a bias value applied to the transfer roller 35 at the time of the image formation. The first bias value indicates a polarity opposite to that of a charge of the toner. The transfer roller 35 has a force for attracting the toner by static electricity by being applied with the first bias value. The second bias value is a bias value applied to the transfer roller 35 at the time of the cleaning. The second bias value indicates a polarity identical to that of the charge charged to the toner. The transfer roller 35 repels the toner by the static electricity when the second bias value is applied thereto. Thus, if the second bias value is applied to the transfer roller 35, the toner adhering to the transfer roller is separated from the transfer roller 35 by the electrostatic force. As a result, it is possible to remove the toner from the surface of the transfer roller 35.

The sensor 44 is used to detect occurrence of an abnormality in the image forming apparatus 100. A plurality of sensors 44 may be arranged in the image forming apparatus 100. The sensor 44 may detect occurrence of a state where the image forming process should not be continued in the image forming apparatus 100, for example. The sensor 44 may detect that the main body cover 150 is opened, for example. The sensor 44 may detect occurrence of jam in the printer section 130, for example. The sensor 44 sends an abnormal signal indicating the occurrence of an abnormality to the control section 451 of the processor 45 if the occurrence of an abnormality is detected.

The processor 45 is, for example, a CPU (Central Processing Unit). The processor 45 functions as the control section 451, a determination section 452 and a timer 453 by executing predetermined programs.

The control section 451 controls each of the functional sections of the image forming apparatus 100. The control section 451 controls the exposure device 33, the charge removing device 36, the drive device 41, the charge roller application circuit 42 and the transfer roller application circuit 43, for example, during the execution of the image forming process. The control section 451 controls the transfer roller application circuit 43 to operate at the first bias value in a case in which the image forming process is being executed. On the other hand, the control section 451 controls the transfer roller application circuit 43 to operate at the second bias value in a case in which the cleaning process is being executed. The cleaning process is executed, for example, in a case in which the image forming apparatus 100 is restored after the abnormality is detected by the sensor 44. The control section 451 executes the cleaning process at the execution time of the cleaning process determined by the determination section 452 at the time the cleaning process is executed.

The control section 451 determines to execute the cleaning process if the image forming apparatus 100 is restored after the process including the charging of the photoconductive drum 31, is interrupted. Specifically, the control section 451 may determine to execute the cleaning process if the image forming apparatus 100 is restored after the process is interrupted during the execution of the image forming process, for example. The control section 451 may determine to execute the cleaning process if the image forming apparatus 100 is restored after the process is interrupted during the pre-run operation, for example. The interruption of the process may be executed by the control section 451, for example, in a case in which the abnormality is detected by the sensor 44 of the image forming apparatus 100. The interruption of the process may be generated depending on, for example, the stop of the supply of the power to the image forming apparatus 100. The interruption of the process may be generated by any factor. The restoration of the image forming apparatus 100 may be determined depending on, for example, a state where the power is supplied to the image forming apparatus 100, and the abnormality is not detected. At the time the cleaning process is executed, the control section 451 may apply a predetermined bias value (e.g., the second bias value) to the transfer roller 35. Any other methods may be applicable to the implementation of the cleaning process.

The determination section 452 determines an execution time for the cleaning process. For example, a cleaning bias may be applied to the transfer roller 35 for the duration of the execution time. The determination section 452 acquires an interruption time, which is measured after the process including the charging of the photoconductive drum 31, is interrupted, and is equal to the amount of time elapsed while the photoconductive drum 31 is in a charged state. The determination section 452 acquires the interruption time using the timer 453 in a case in which the power is supplied to the image forming apparatus 100 after the interruption of the process. The determination section 452 acquires a point in time at which the power supply is stopped and a point in time at which the power supply is restored, in a case in which the interruption of the process corresponds to the power not being supplied to the image forming apparatus 100. The determination section 452 acquires the interruption time on the basis of a difference between the two points in time.

The determination section 452 determines the execution time depending on a length of the interruption time. The determination section 452 determines the execution time to be shorter as the interruption time becomes longer. The determination section 452 determines the execution time to be longer as the interruption time becomes shorter. The determination section 452 may determine the execution time of the cleaning process according to, for example, an execution time table stored in an execution time table storage section 461.

The timer 453 measures the interruption time. The timer 453, for example, starts the timing depending on the control of the determination section 452, and stops the timing depending on the control of the determination section 452. The timer 453 outputs a timing result when the timing is stopped.

The storage device 46 is a storage device such as a magnetic hard disk device and a semiconductor storage device. The storage device 46 functions as the execution time table storage section 461.

The execution time table storage section 461 stores the execution time table. FIG. 4 is a diagram illustrating a specific example of the execution time table. The execution time table has a plurality of records associated with the interruption time and the execution time. For example, the execution time "40 seconds" is associated with the interruption time "0-5 minutes". Furthermore, the interruption time "0-5 minutes" indicates that the interruption time is greater than or equal to 0 minute and smaller than or equal to 5 minutes. The same applies to interruption time of other records. As shown in FIG. 4, relatively long execution time is associated with relatively short interruption time.

Figure 5:
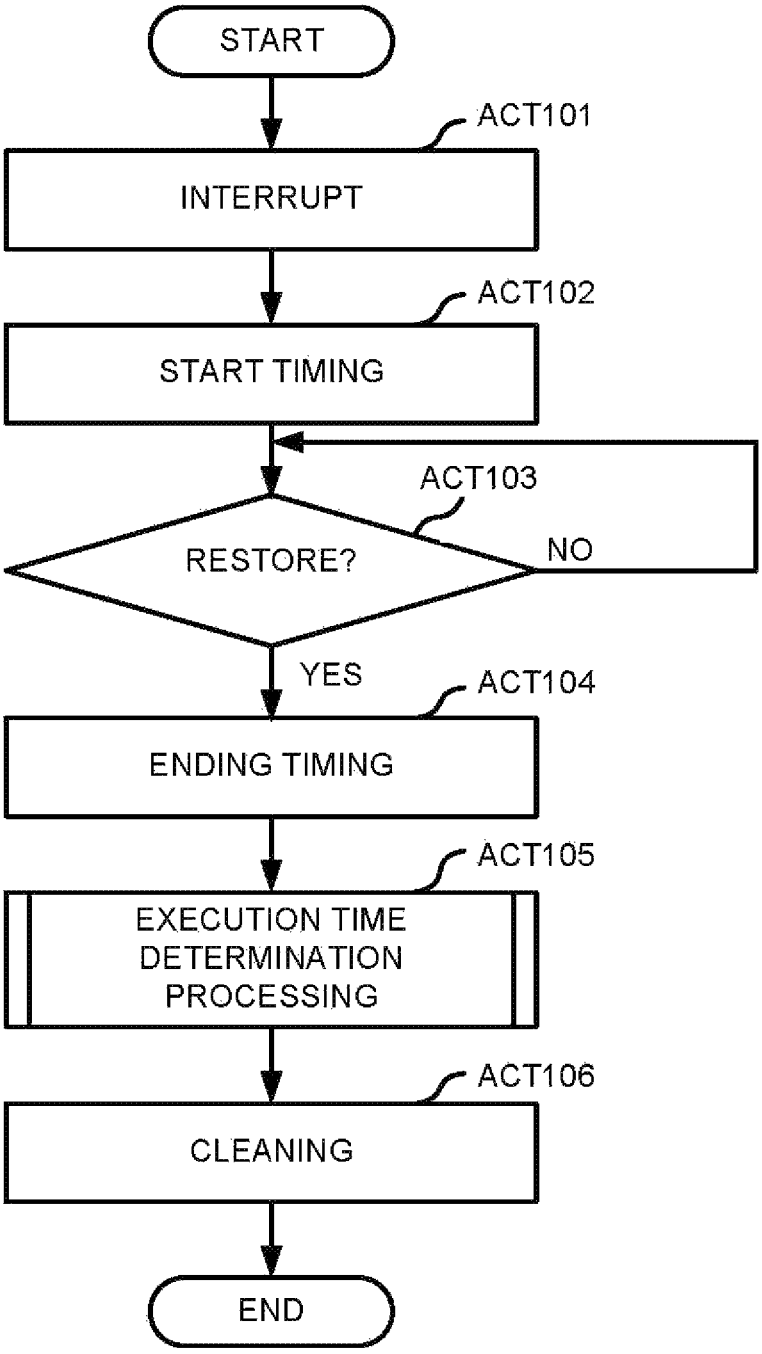
FIG. 5 is a flowchart illustrating an example of operations of the image forming apparatus.

FIG. 5 is a flowchart illustrating an example of operations of the image forming apparatus 100. If the process including the charging of the photoconductive drum 31, is interrupted (ACT 101), the control section 451 notifies the determination section 452 of the occurrence of the interruption. The determination section 452 starts the timing by the timer 453 (ACT 102) upon receiving the notification of the occurrence of the interruption. The control section 451 repeatedly determines whether or not the image forming apparatus 100 has been restored (No in ACT 103). If it is determined that the image forming apparatus 100 has been restored (Yes in ACT 103), the control section 451 notifies the determination section 452 that the image forming apparatus 100 has been restored. The determination section 452 ends the timing (ACT 104) if the image forming apparatus 100 has been restored. The determination section 452 acquires the amount of time elapsed from the interruption to the restoration as the interruption time. The determination section 452 executes an execution time determination process on the basis of the interruption time (ACT 105). The determination section 452 determines the execution time of the cleaning process through the execution of the execution time determination process. The determination section 452 acquires a record corresponding to the measured interruption time from a plurality of records in the execution time table. The determination section 452 determines a value of the execution time of the acquired record as the execution time. The control section 451 executes the cleaning process at the execution time determined by the determination section 452 (ACT 106).

Figure 6:
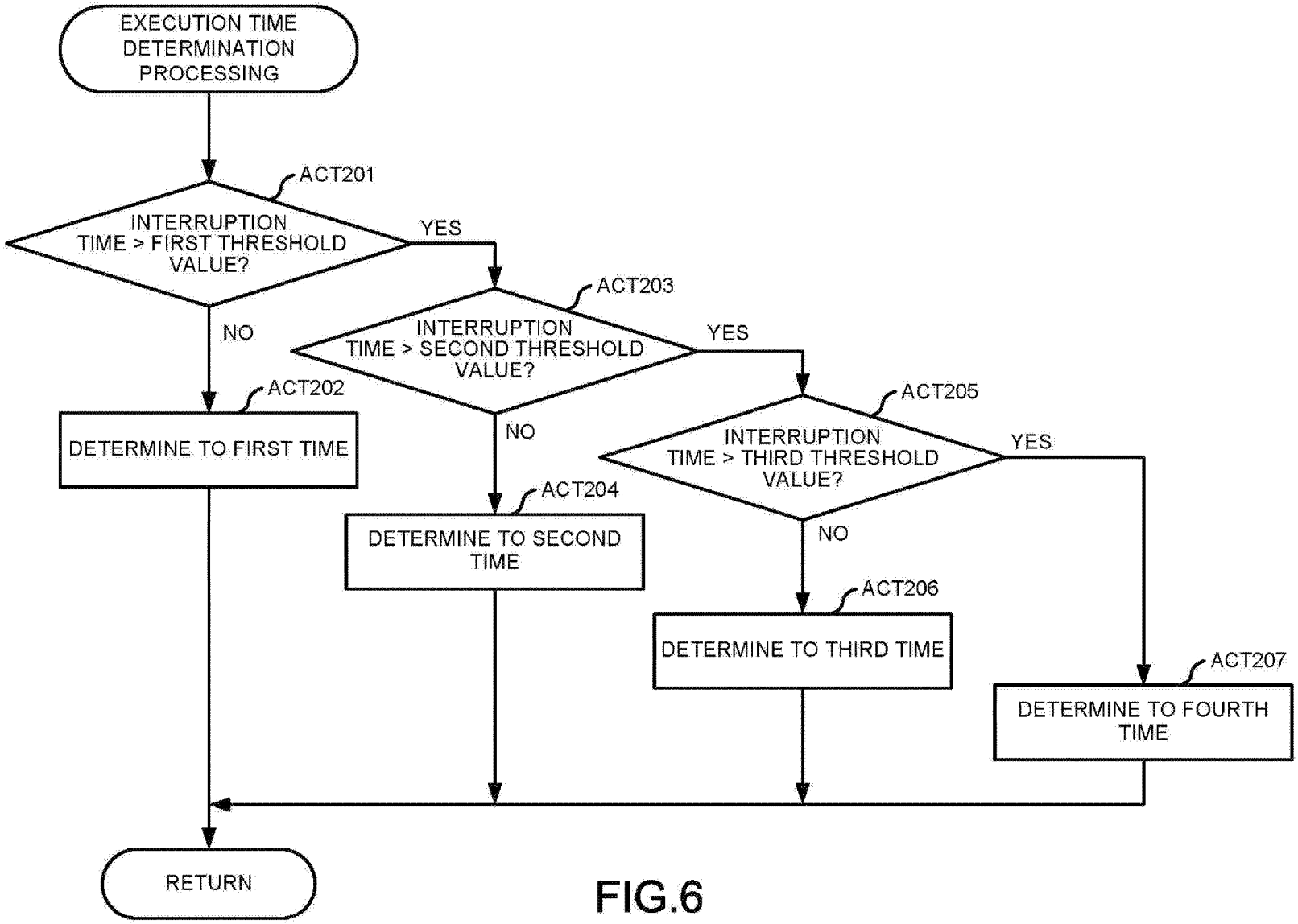
FIG. 6 is a flowchart illustrating a specific example of an execution time determination process.

FIG. 6 is a flowchart illustrating a specific example of the execution time determination process. Hereinafter, the flow of the process shown in FIG. 6 is described. First, the determination section 452 determines whether or not the measured interruption time is greater than a predetermined first threshold value (ACT 201). The first threshold value is, for example, "5 minutes". If the interruption time is smaller than or equal to the first threshold value (No in ACT 201), the determination section 452 determines predetermined first time as the execution time (ACT 202). The first time is, for example, "40 seconds".

If the interruption time is greater than the first threshold value (Yes in ACT 201), the determination section 452 determines whether or not the measured interruption time is greater than a predetermined second threshold value (ACT 203). The second threshold value is, for example, "10 minutes". If the interruption time is smaller than or equal to the second threshold value (No in ACT 203), the determination section 452 determines predetermined second time as the execution time (ACT 204). The second time is, for example, "20 seconds".

If the interruption time is greater than the second threshold value (Yes in ACT 203), the determination section 452 determines whether or not the measured interruption time is greater than a predetermined third threshold value (ACT 205). The third threshold value is, for example, "15 minutes". If the interruption time is smaller than or equal to the third threshold value (No in ACT 205), the determination section 452 determines predetermined third time as the execution time (ACT 206). The third time is, for example, "10 seconds". On the other hand, if the interruption time is greater than the third threshold value (Yes in ACT 205), the determination section 452 determines a predetermined fourth time as the execution time (ACT 207). The fourth time is, for example, "5 seconds".

Figure 7:
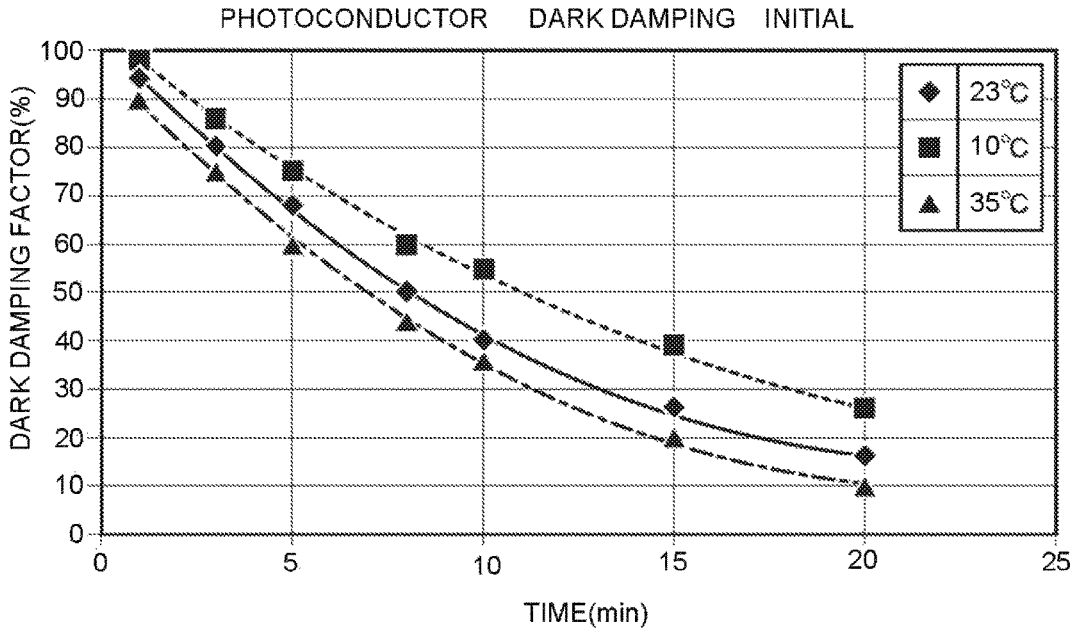
FIG. 7 is a graph illustrating a relationship between a dark damping factor of a photoconductor and time.

FIG. 7 is a graph illustrating a relationship between a dark damping factor of a photoconductor and time. The dark damping factor is a value indicating charging performance of the photoconductor per time. As shown in FIG. 7, it is obvious that the value of the dark damping factor becomes small with the elapse of time even in any temperature environment.

Figure 8:
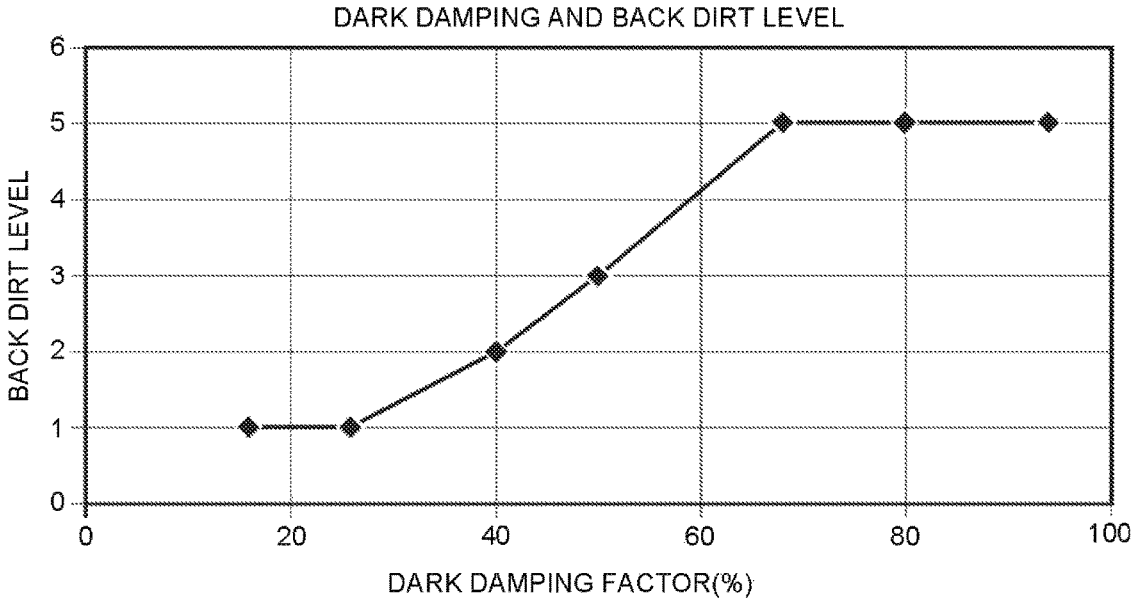
FIG. 8 is a graph illustrating a relationship between a dark damping factor and a back dirt level.

FIG. 8 is a graph illustrating a relationship between a dark damping factor and a back dirt level. The value of the back dirt level indicates a degree of dirt generated by the adhesion of the toner to the back of the sheet at the time of the image formation at a point of time of this dark damping factor. It is assumed that more toner adheres as the value of the back dirt level is higher. It is obvious that the value of the back dirt level becomes higher as the value of the dark damping factor is higher.

Figures 9, 10:
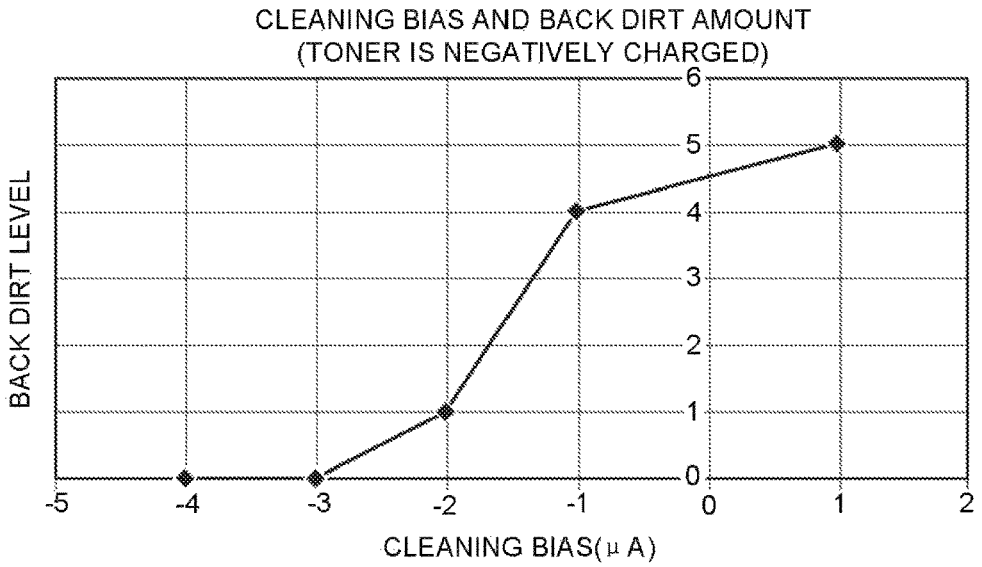
FIG. 9 is a graph illustrating a relationship between a magnitude of a cleaning bias and a back dirt level.
FIG. 10 a diagram illustrating a modification of the execution time table.

FIG. 9 is a graph illustrating a relationship between a size of a cleaning bias and a back dirt level. The value of the back dirt level indicates a degree of dirt generated by the adhesion of the toner to the back of the sheet at the time of the image formation after the execution of the cleaning process at the cleaning bias of a particular magnitude. It is assumed that more toner adheres as the value of the back dirt level is higher. It is obvious that the value of the back dirt level becomes lower as an absolute value of the cleaning bias is higher. For example, an absolute value of a current I used for the cleaning process may be set to a value of 3 microamperes or more on the basis of the result in FIG. 9.

In the image forming apparatus 100 configured as described above, the interruption time, which is the amount of time elapsed after the process including the charging of the photoconductive drum 31 is interrupted, is measured. The execution time of the cleaning process is determined depending on the interruption time. Specifically, the execution time is determined to be shorter as the interruption time is longer. On the other hand, the execution time is determined to be longer as the interruption time is shorter. That the interruption time is long means that a possibility is high that more charges existing on the surface of the photoconductive drum 31 are lost at the point of time of the occurrence of the interruption. Thus, that the interruption time is long means that a possibility is high that an adhesion amount is less even if the toner adheres to the surface of the photoconductive drum 31 at the time of the restart of the image forming process. On the other hand, that the interruption time is short means that a possibility is high that more charges existing on the surface of the photoconductive drum 31 are left at the point of time of the occurrence of the interruption. Thus, that the interruption time is short means that a possibility is high that more toner adheres to the surface of the photoconductive drum 31 at the time of the restart of the image forming process. By determining the execution time as described above, the removal of the toner adhering to the photoconductive drum 31 can be achieved more reliably, and time required for the removal of the toner can be shortened.

The determination section 452 may determine the execution time on the basis of other values in addition to the interruption time. For example, the determination section 452 may determine the execution time on the basis of the interruption time and information indicating opening and closing of the main body cover 150. FIG. 10 is a diagram illustrating a specific example of the execution time table in a case in which the determination section 452 is configured in this manner. The determination section 452 determines the execution time using a value located in the column of "cover is closed" in a case in which the main body cover 150 is not opened at the time of the interruption. On the other hand, the determination section 452 determines the execution time using a value located in the column of "cover is opened" in a case in which the main body cover 150 is opened at the time of the interruption. Whether the main body cover 150 is opened may be detected by the sensor 44, for example. In a case in which the main body cover 150 is opened, light enters the inside of the image forming apparatus 100. Thus, a possibility that the light strikes the surface of the photoconductive drum 31 is high. In a case in which the light strikes the surface of the photoconductive drum 31, the potential of the surface of the photoconductive drum 31 is removed by the light. In this case, charge removal of the surface of the photoconductive drum 31 can be achieved in the cleaning process of shorter execution time. Thus, it is possible to complete the execution time of the cleaning process in a short time.

The execution time may be determined on the basis of other values other than the opening of the main body cover 150. As shown in FIG. 7, a change amount of the dark damping factor in the same time can vary. Thus, the determination section 452 may determine the execution time on the basis of a temperature in addition to the interruption time. As shown in FIG. 7, the dark damping factor becomes a lower value as the temperature is higher. Thus, the determination section 452 may determine the execution time required for the cleaning process to be shorter as the temperature is higher.

Figures 11, 12:
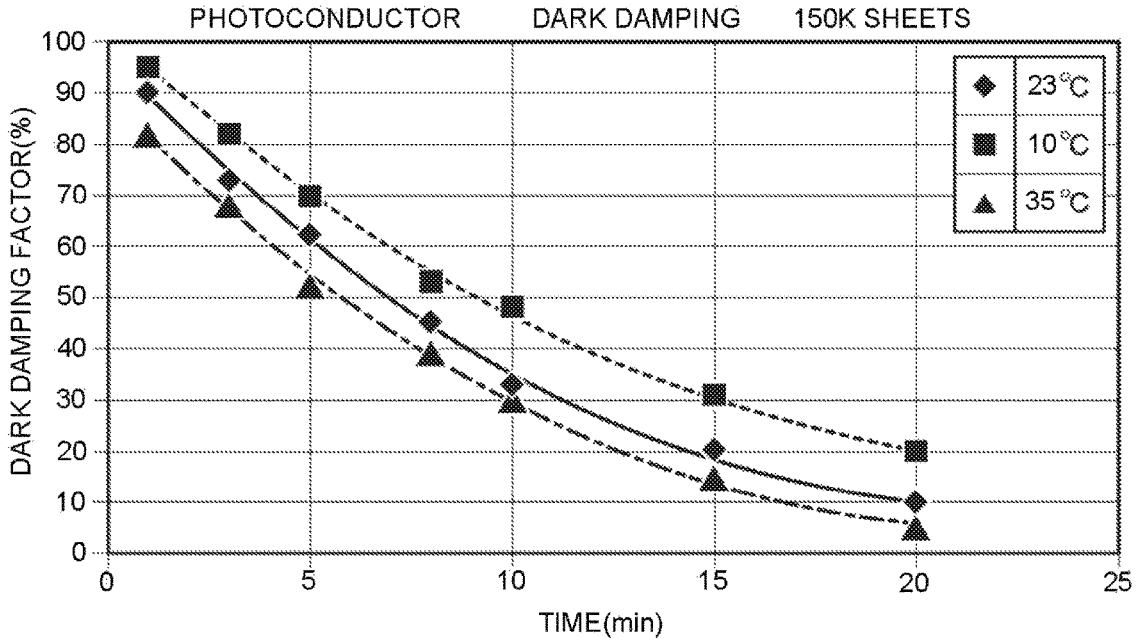
FIG. 11 is a graph illustrating a relationship between a dark damping factor of a photoconductor and time.
FIG. 12 is a table illustrating a relationship between a number of rotations of a transfer roller during a cleaning process and the back dirt level in the transfer roller.

For example, the determination section 452 may determine the execution time on the basis of a film wear amount of the photoconductive drum 31 in addition to the interruption time. FIG. 11 is a graph illustrating a relationship between a dark damping factor of a photoconductor and time in the image forming apparatus 100 that 150,000 sheets pass through. As the 150,000 sheets pass, the film of the photoconductive drum 31 becomes a worn state. As can be seen by comparing FIG. 7 with FIG. 11, the change amount of the dark damping factor in the same time becomes large in the image forming apparatus of the photoconductive drum 31 of which the film is worn in any temperature environment. Thus, the determination section 452 may determine the execution time on the basis of the film wear amount in addition to the interruption time. Specifically, the determination section 452 may determine the execution time required for the cleaning process to be shorter as the film wear amount is larger. The film wear amount may be presumed on the basis of, for example, an accumulated value of rotation times of the photoconductive drum 31, an accumulated value of the number of printing sheets of the image forming apparatus 100, and an accumulated value of drive time of the image forming apparatus 100.

The execution time may be represented as the rotation times of the transfer roller 35 at the time of the cleaning process. FIG. 12 is a table illustrating a relationship between a number of rotations of the transfer roller 35 during the cleaning process and the back dirt level in the transfer roller 35. For example, for the transfer roller 35 having a back dirt level "5" at a point of time when the cleaning process is started, the back dirt level at the eighth rotation becomes "0". On the other hand, for the transfer roller 35 having a back dirt level "1" at a point of time when the cleaning process is started, the back dirt level at the second rotation becomes "0". As can be seen from FIG. 12, more rotation of the transfer roller 35 is required as the back dirt level is higher. Thus, cleaning can be achieved more reliably by rotating the transfer roller 35 more times in the cleaning process as the interruption time is shorter (which means the back dirt level is higher).

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a photoconductive drum;

a transfer roller configured to transfer a visible image formed on the photoconductive drum to a sheet; and a processor configured to acquire an interruption time, which is measured after a process including charging of the photoconductive drum is interrupted, and is equal to an amount of time elapsed while the photoconductive drum is in a charged state, determine a cleaning time depending on the interruption time, and execute a cleaning process on the transfer roller for the duration of the cleaning time.

2. The image forming apparatus according to claim 1, wherein the processor determines the cleaning time depending on a wear amount of a film of the photoconductive drum and the interruption time.

3. The image forming apparatus according to claim 1, wherein the processor determines the cleaning time depending on a temperature around or inside the image forming apparatus and the interruption time.

4. The image forming apparatus according to claim 1, wherein the processor determines the cleaning time depending on information indicating whether or not a cover of a main body of the image forming apparatus is opened and the interruption time.

5. The image forming apparatus according to claim 4, wherein the processor determines the cleaning time to be shorter when the cover is opened, relative to when the cover is closed.

6. The image forming apparatus according to claim 1, wherein the cleaning process includes removing a developing agent that has adhered to a surface of the transfer roller.

7. The image forming apparatus according to claim 6, further comprising:

a first circuit configured to apply a charge to the transfer roller, wherein the processor controls the first circuit to apply a charge to the transfer roller to generate a force for repelling the developing agent, during the cleaning process.

8. The image forming apparatus according to claim 1, wherein a magnitude of a current used during the cleaning process is 3 microamperes or more.

9. The image forming apparatus according to claim 1, wherein the processor controls the cleaning time of the cleaning process using a rotation number of the transfer roller that is equivalent to the cleaning time.

10. The image forming apparatus according to claim 1, wherein the processor determines the cleaning time to be shorter as the interruption time becomes longer, and determines the cleaning time to be longer as the interruption time becomes shorter.

11. A control method executed in an image forming apparatus including a photoconductive drum and a transfer roller configured to transfer a visible image formed on the photoconductive drum to a sheet, said method comprising:

acquiring an interruption time, which is measured after a process including charging of the photoconductive drum is interrupted, and is equal to an amount of time elapsed while the photoconductive drum is in a charged state;

determining a cleaning time depending on the interruption time; and executing a cleaning process on the transfer roller for the duration of the cleaning time.

12. The control method according to claim 11, wherein the cleaning time is determined depending on a wear amount of a film of the photoconductive drum and the interruption time.

13. The control method according to claim 11, wherein the cleaning time is determined depending on a temperature around or inside the image forming apparatus and the interruption time.

14. The control method according to claim 11, wherein the cleaning time is determined depending on information indicating whether or not a cover of a main body of the image forming apparatus is opened and the interruption time.

15. The control method according to claim 14, wherein the cleaning time is determined to be shorter when the cover is opened, relative to when the cover is closed.

16. The control method according to claim 11, wherein the cleaning process includes removing a developing agent that has adhered to a surface of the transfer roller.

17. The control method according to claim 16, further comprising:

applying a charge to the transfer roller during the cleaning process to generate a force for repelling the developing agent.

18. The control method according to claim 11, wherein a magnitude of a current used during the cleaning process is 3 microamperes or more.

19. The control method according to claim 11, wherein the cleaning time of the cleaning process is controlled using a rotation number of the transfer roller that is equivalent to the cleaning time.

20. The control method according to claim 11, wherein the cleaning time is determined to be shorter as the interruption time becomes longer, and determined to be longer as the interruption time becomes shorter.

* * * * *